US006633270B2

(12) United States Patent
Hashimoto

(10) Patent No.: US 6,633,270 B2
(45) Date of Patent: Oct. 14, 2003

(54) DISPLAY DEVICE

(75) Inventor: Yoshiharu Hashimoto, Tokyo (JP)

(73) Assignee: NEC Electronics Corporation, Kanagawa (JP)

( * ) Notice: Subject to any disclaimer, the term of this patent is extended or adjusted under 35 U.S.C. 154(b) by 154 days.

(21) Appl. No.: 09/912,491

(22) Filed: Jul. 26, 2001

(65) Prior Publication Data

US 2002/0011976 A1 Jan. 31, 2002

(30) Foreign Application Priority Data

Jul. 28, 2000 (JP) ..... 2000-228405

(51) Int. Cl.[7] ..... G09G 3/30

(52) U.S. Cl. ..... 345/76; 345/36; 345/45; 345/72; 345/92; 315/169.1; 315/169.3; 315/169.4

(58) Field of Search ..... 345/36, 45, 72, 345/76, 92; 315/169.1, 169.3, 169.4

(56) References Cited

U.S. PATENT DOCUMENTS 6,175,345 B1 * 1/2001 Kuribayashi et al. ..... 345/76

FOREIGN PATENT DOCUMENTS

JP 7-326311 12/1995
JP 10-112391 4/1998
JP 10-239655 9/1998

* cited by examiner

*Primary Examiner*—Richard Hjerpe
*Assistant Examiner*—Jean Lesperance
(74) *Attorney, Agent, or Firm*—McGinn & Gibb, PLLC

(57) ABSTRACT

A display device includes (a) a plurality of pixels arranged in a matrix, each of the pixels including a light-emitting device, a switch and a transistor, (b) a scanning line extending in a first direction, (c) a data line extending in a second direction perpendicular to the first direction, (d) a first bias voltage line extending in the second direction, (e) a bias voltage generating circuit which applies a bias voltage to the bias voltage line, (f) a second bias voltage line which surrounds the pixels and is a closed line, and (g) a third bias voltage line which electrically connects the bias voltage generating circuit to the second bias voltage line. The first bias voltage line is electrically connected at opposite ends thereof to the second bias voltage line. The switch is turned on when the scanning line is activated, to thereby allow image signals to be transmitted to the gate of the transistor therethrough from the data line. The second and third bias voltage lines are designed to have such a wire resistance that a constant current is supplied to the light-emitting device from the bias voltage generating circuit through the first, second and third bias voltage lines.

30 Claims, 6 Drawing Sheets

21A
21
21B
21C

BIAS VOLTAGE GENERATING CIRCUIT
11
13C
DATA LINE DRIVER CIRCUIT
68
65
66
67
14
141B
142B
12
13
21A
21
21C
141A
142A
SCANNING LINE DRIVER CIRCUIT
69

DISPLAY DEVICE

BACKGROUND OF THE INVENTION

1. Field of the Invention

The invention relates to a display device including an active device, and more particularly to an active matrix type display device including a spontaneous light-emitting device such as an organic electroluminescence (EL).

2. Description of the Related Art

A portable communication terminal such as a cellular phone has been widely used recently. As a display unit of such a portable communication terminal, a liquid crystal display device is widely used.

A liquid crystal display device including a back light unit is accompanied with a problem of much power consumption for enhancing a brightness in a display screen. To solve this problem, a display device including an organic electroluminescence (hereinafter, referred to simply as "organic EL display device") attracts an attention as a display device suitable to a portable communication terminal, as having been suggested in Nikkei Electronics, No. 765, Mar. 13, 2000, pp. 55–62.

Hereinbelow is set forth a summary of Nikkei Electronics, No. 765, Mar. 13, 2000, pp. 55–62.

As a display device including a spontaneous light-emitting device which emits a light when a current runs therethrough, there are known a plasma display (PDP) device and an electroluminescence (EL) device. An electroluminescence device is grouped into an inorganic one and an organic one with respect to a material of which an electroluminescence device is composed, and is further grouped into a simple matrix type device and an active matrix type device with respect to a structure.

FIG. 1 is a block diagram of a simple matrix type organic EL display device.

As illustrated in FIG. 1, the simple matrix type organic EL display device includes a data line driver circuit 55 to which a plurality of data lines 53 are electrically connected, a scanning line driver circuit 56 to which a plurality of scanning lines 54 are electrically connected, and a plurality of pixels arranged in a matrix.

Each of the pixels is comprised of an electroluminescence device 51, a capacitor 52 electrically connected between an anode and a cathode of the electroluminescence device 51, one of the data lines 53 to which the anode of the electroluminescence device 51 is electrically connected, and one of the scanning lines 54 to which the cathode of the electroluminescence device 51 is electrically connected.

The data line driver circuit 55 activates one of the data lines 53 and the scanning line driver circuit 56 activates one of the scanning lines 54 to thereby supply the electroluminescence device 51 electrically connected to the thus activated data and scanning lines 53 and 54, with a current from the activated data line 53 towards the activated scanning line 54. As a result, the electroluminescence device 51 emits a light with a brightness determined in accordance with the current running through the electroluminescence device 51.

Since a simple matrix type organic EL display device has a relatively simple structure as mentioned above, it can be fabricated with low costs. However, it is difficult for a simple matrix type organic EL display device to increase the number of pixels for accomplishing a higher density in pixels.

Since a scanning line is selected one by one, and then, a light-emitting diode in an associated pixel is made to emit a light in a simple matrix type organic EL display device, a period of time during which a light-emitting diode in a pixel emits a light is equal to A/B wherein A indicates a frame period and B indicates the number of scanning lines. In order to keep a brightness constant in such a limited period of time, it would be necessary to instantaneously flow a much current through a pixel.

If the number of pixels is increased, the data line 53 would have an increased wire length. The data lines 53 are generally composed of a transparent material such as ITO (Indium Tin Oxide), and hence, has a high wire resistivity. As a result, as the data lines 53 have an increased wire length, the data lines 53 would have an increased wire resistance.

Thus, there occurs a significant voltage drop in the data lines 53, because the data lines 53 have an increased wire resistance, and further because a much current runs through the data lines 53.

Such a significant voltage drop results in that a voltage on the data line 53 located farther away from the data line driver circuit 55 becomes smaller than a voltage on the data line 53 located closer to the data line driver circuit 55. This causes that a smaller current runs through the electroluminescence device 51 electrically connected to the data line 53 located farther away from the data line driver circuit 55.

That is, since a smaller current runs through the electroluminescence device 51 electrically connected to the data line 53 located farther away from the data line driver circuit 55, because of an increased wire resistance of the data lines 53, the electroluminescence device 51 would emit a light in a smaller amount, resulting in non-uniformity in a brightness in a display screen. Specifically, a pixel located farther away from the data line driver circuit 55 would have a smaller brightness.

FIG. 2 is a block diagram of a conventional active matrix type organic electroluminescence display device.

As illustrated in FIG. 2, the conventional active matrix type organic EL display device includes a data line driver circuit 68 to which a plurality of data lines 65 are electrically connected, a scanning line driver circuit 69 to which a plurality of scanning lines 66 are electrically connected, a bias voltage source 610, a common bias voltage line 611 through which a bias voltage is applied from the bias voltage source 610, a plurality of bias voltage lines 67 electrically connected to the bias voltage line 611, and a plurality of pixels arranged in a matrix.

Each of the pixels is comprised of an electroluminescence device 61, a first thin film transistor (TFT) 62 electrically connected between an anode of the electroluminescence device 61 and one of the bias voltage lines 67, a second thin film transistor (TFT) 63 electrically connected between one of the data lines 65 and a gate of the first thin film transistor 62, and a capacitor 64 electrically connected between a gate of the first thin film transistor 62 and one of the bias voltage lines 67.

When the scanning line driver circuit 69 activates one of the scanning lines 66, the second thin film transistor 63 electrically connected to the thus activated scanning line 66 is turned on, and hence, a current runs to the capacitor 64 through the data line 65 and the second thin film transistor 63 from the data line driver circuit 68, resulting in that the capacitor 64 is electrically charged.

Thus, a gate voltage of the first thin film transistor 62 becomes high. When the gate voltage of the first thin film transistor 62 becomes higher than a threshold voltage, the first thin film transistor 62 is turned on, resulting in that a current is supplied to the electroluminescence device 61 through the common bias voltage line 611 and the bias voltage line 67 from the bias voltage source 610. Thus, the electroluminescence device 610 emits a light at a brightness in accordance with the current supplied thereto.

As is obvious in view of the above, the active matrix type organic EL display device and is characterized in that even if the number of scanning lines were increased, it is ensured to have a period of time during which a light is emitted, equal to a frame period of time, differently from the simple matrix type organic EL display device.

Herein, an active matrix type liquid crystal display device is compared to the above-mentioned active matrix type organic EL display device.

In an active matrix type liquid crystal display device, a transmissivity, which corresponds to a brightness in an active matrix type organic EL display device, is in proportion to a voltage to be applied to liquid crystal. In contrast, a brightness in an active matrix type organic EL display device is in proportion to a current, and a voltage supplied to the bias voltage lines 67 from the bias voltage source 610 is fixed at a constant voltage.

Since an organic EL display device is driven by a current, a thin film transistor simply conducting an on/off operation cannot be used in an organic EL display device unlike an active matrix type liquid crystal display device. An organic EL display device has to use a thin film transistor having an on-resistance small enough for a current to run therethrough.

Such a thin film transistor having a small on-resistance cannot be fabricated by a process for fabricating an amorphous silicon thin film transistor, and hence, has to be fabricated by a process for fabricating a low-temperature polysilicon thin film transistor which process is usually used for fabricating a display device capable of displaying images with high accuracy.

In a low-temperature polysilicon thin film transistor, a thin film transistor and a driver circuit can be fabricated on a glass substrate. When multi gradation display is to be accomplished, almost all circuits associated with scanning lines and a part of circuits (selection switches) associated with data lines are fabricated on a glass substrate, and a complex circuit for controlling gradation is comprised of a semiconductor integrated circuit formed on a singly crystal substrate.

An active matrix type liquid crystal display device uses red, green and blue color filters for displaying colored images.

In contrast, an active matrix type organic EL display device uses organic EL devices emitting red, green and blue lights, for displaying colored images.

However, the active matrix type organic EL display device is accompanied with problems that an organic EL device emitting a red light has a shorter lifetime than those of organic EL devices emitting green and blue lights, and that the organic EL device does not emit a pure red light, but emit an orange light.

In the active matrix type organic EL display device, red, green and blue lights may be mixed to one another to thereby produce a white light, and pixels associated with red, green and blue may be fabricated through the use of color filters like a liquid crystal display device.

In the above-mentioned simple matrix type organic EL display device, as the number of pixels is increased, a data line would have a longer wire length, and hence, have a greater wire resistance.

Thus, a voltage drop would occur in a data line because of an increase in a wire resistance thereof and further because of a much current running through a data line. This causes a problem that since a current running through an electroluminescence device electrically connected to a data line located remote from the data line driver circuit is reduced, the electroluminescence device would emit a light in a smaller amount, resulting in non-uniformity in a brightness in a display screen.

On the other hand, though the active matrix type organic EL display device has a merit that a period of time during which the display device can emit a light which period is equal to a frame period of time can be ensured, the active matrix type organic EL display device is accompanied with the following problem like the above-mentioned simple matrix type organic EL display device.

Bias voltage lines or transparent electrodes would have an increased wire resistivity and an increased wire resistance, as the number of pixels is increased. This results in that the bias voltage lines would have an increased wire resistance, a pixel located far away from the bias voltage source would have a reduced brightness, and hence, non-uniformity occurs in a display screen of the active matrix type organic EL display device.

A further problem common to the conventional simple matrix type organic EL display device and the conventional active matrix type organic EL display device is that extra power has to be supplied to the bias voltage lines from the bias voltage source in order to compensate for reduction in a brightness in a pixel which reduction is caused by an increase in a wire resistance in the bias voltage lines. This problem is quite serious to a display device required to accomplish reduction in power consumption.

Japanese Unexamined Patent Publication No. 7-326311 has suggested an electron source including M wires extending in a row direction, formed on an electrically insulating substrate, N wires extending in a column direction, formed on said row-direction wires with an insulating layer sandwiched therebetween, and a surface conductive type electron emitting device including a thin film having at least one pair of electrodes and an electron emitter. Each of the electrodes is electrically connected to both the row-direction wires and the column-direction wires. A plurality of the surface conductive type electron emitting devices are arranged in a matrix. The row- and column-direction wires are designed to include terminals through which a voltage is applied thereto, at opposite ends.

Japanese Unexamined Patent Publication No. 10-112391 has suggested a X-Y matrix type organic thin film electroluminescence display device including a light-emitting layer composed at least of organic material. In the display device, an electrode for a high resistance is electrically connected to a data electrode wire, and an electrode for a low resistance is electrically connected to a scanning electrode wire, to thereby reduce a voltage drop caused by a wire resistance.

Japanese Unexamined Patent Publication No. 10-239655 has suggested a liquid crystal display device including an upper signal line driver circuit and a lower signal line driver circuit between which signal lines extend. The upper and lower signal line driver circuits are electrically connected to each other through first and second power lines. Branch lines extend from the first and second power lines, and are electrically connected to a liquid crystal driver circuit. The first power line is designed such that a half of the first power line extending from a point at which the branch line extend to the liquid crystal driver circuit, to an end of the first power line has a wire resistance equal to a wire resistance of the other half extending from the point to the other end of the first power line. Similarly, the second power line is designed such that a half of the second power line extending from a point at which the branch line extend to the liquid crystal driver circuit, to an end of the second power line has a wire resistance equal to a wire resistance of the other half extending from the point to the other end of the second power line.

SUMMARY OF THE INVENTION

In view of the above-mentioned problems in the conventional display devices, it is an object of the present invention to provide a display device which is capable of, even if a bias voltage line would have an increased wire length because of an increase in the number of pixels, reducing and uniformizing a wire resistance of a bias voltage line extending from a bias voltage generating circuit to each of pixels, avoiding reduction in a brightness caused by reduction in a current running through a light-emitting device, resulted from an increase in a wire resistance in a bias voltage line, and avoiding non-uniformity in a brightness in a display screen, caused by non-uniformity in a wire resistance in bias voltage lines extending from a bias voltage generating circuit to each of pixels.

It is also an object of the present invention to provide a display device which is capable of reducing a wire resistance in bias voltage lines to thereby reduce power consumption in the bias voltage lines.

There is provided a display device including (a) a plurality of pixels arranged in a matrix, each of the pixels including a light-emitting device, a switch and a transistor, (b) at least one scanning line extending in a first direction, (c) at least one data line extending in a second direction perpendicular to the first direction, (d) at least one first bias voltage line extending in the second direction, (e) a bias voltage generating circuit which applies a bias voltage to the bias voltage line, (f) a second bias voltage line which surrounds the pixels, and (g) a third bias voltage line which electrically connects the bias voltage generating circuit to the second bias voltage line. The light-emitting device is electrically connected to one of a source and a drain of the transistor. The first bias voltage line is electrically connected to the other of a source and a drain of the transistor. The transistor has a gate electrically connected to the data line through the switch. The first bias voltage line is electrically connected at opposite ends thereof to the second bias voltage line. The switch is turned on when the scanning line is activated, to thereby allow image signals to be transmitted to the gate of the transistor therethrough from the data line. The second and third bias voltage lines are designed to have such a wire resistance that a constant current is supplied to the light-emitting device from the bias voltage generating circuit through the first, second and third bias voltage lines.

It is preferable that the second bias voltage line is rectangular in shape.

The display device may further include a first driver which drives the scanning line a second driver which drives the data line.

The display device may further include a capacitor electrically connected between the gate and the source or drain of the transistor.

It is preferable that the light-emitting device is comprised of an electroluminescence (EL) device.

It is preferable that the second bias voltage line is comprised of a plurality of bias voltage line segments, and that a bias voltage line segment located closer to the bias voltage generating circuit is designed to have a smaller wire resistance per a unit length.

It is preferable that the second bias voltage line is comprised of a plurality of bias voltage line segments, and that a bias voltage line segment located closer to the bias voltage generating circuit is designed to have a broader width.

It is preferable that the bias voltage line segment is tapered in width.

It is preferable that the second bias voltage line is comprised of a first wiring layer having a resistivity smaller than a predetermined resistivity, and a wiring layer of the scanning or data line, the first wiring layer and the wiring layer being vertically layered one on another, the first wiring layer and the wiring layer being connected to each other through a through-hole.

It is preferable that the second bias voltage line has an inner area defined as an area surrounded by itself, the inner area being greater than a predetermined area such that the second bias voltage line acts as a capacitor for removal of noises.

The display device may further include at least one bias bus line extending in the first direction between two portions of the second bias voltage line opposing to each other.

The display device may further include bias bus lines extending in the first direction between two portions of the second bias voltage line opposing to each other, the bias bus lines being arranged by every M pixel rows wherein M is an integer equal to or greater than 1.

The display device may further include bias bus lines extending in the first direction between two portions of the second bias voltage line opposing to each other, the bias bus lines being arranged by every non-constant number of pixel rows.

It is preferable that the second bias voltage line is configured to be a closed loop.

It is preferable that the third bias voltage line has a width greater than a width of said second bias voltage line.

There is further provided a display device including (a) a plurality of pixels arranged in a matrix, each of the pixels including a light-emitting device, a switch and a transistor, (b) at least one scanning line extending in a column direction, (c) at least one data line extending in a row direction, (d) first to N-th first bias voltage lines extending in the column direction wherein N is an integer equal to or greater than 2, (e) a bias voltage generating circuit having first to N-th output terminals through which a bias voltage is applied to the first to N-th first bias voltage lines, (f) first to N-th second bias voltage lines which surround the pixels, and (g) first to N-th third bias voltage lines which electrically connects the first to N-th output terminals of the bias voltage generating circuit to the first to N-th second bias voltage lines, respectively, the light-emitting device being electrically connected to one of a source and a drain of the transistor, the first to N-th first bias voltage lines being electrically connected to the other of a source and a drain of the transistor in the first to N-th rows, the transistor having a gate electrically connected to the data line through the switch, each of the first to N-th first bias voltage lines being electrically connected at opposite ends thereof to an associated second bias voltage line among the first to N-th second bias voltage lines, the switch being turned on when the scanning line is activated, to thereby allow image signals to be transmitted to the gate of the transistor therethrough from the data line, the first to N-th second and third bias voltage lines being designed to have such a wire resistance that a constant current is supplied to the light-emitting device from the bias voltage generating circuit through the first to N-th first, second and third bias voltage lines.

It is preferable that each of the first to N-th second bias voltage lines is rectangular in shape.

The display device may further include a first driver which drives the scanning line a second driver which drives the data line.

It is preferable that each of the first to N-th second bias voltage line is comprised of a plurality of bias voltage line segments, and that a bias voltage line segment located closer to the bias voltage generating circuit is designed to have a smaller wire resistance per a unit length.

It is preferable that each of the first to N-th second bias voltage lines is comprised of a plurality of bias voltage line segments, and that a bias voltage line segment located closer to the bias voltage generating circuit is designed to have a broader width.

It is preferable that the bias voltage line segment is tapered in width.

It is preferable that each of the first to N-th second bias voltage lines is comprised of a first wiring layer having a resistivity smaller than a predetermined resistivity, and a wiring layer of the scanning or data line, the first wiring layer and the wiring layer being vertically layered one on another, the first wiring layer and the wiring layer being connected to each other through a through-hole.

It is preferable that an innermost second bias voltage line among the first to N-th second bias voltage lines has an inner area defined as an area surrounded by itself, the inner area being greater than a predetermined area such that the innermost second bias voltage line acts as a capacitor for removal of noises.

The display device may further include first to N-th bias bus lines each extending in the column direction between two portions of each of the first to N-th second bias voltage lines opposing to each other.

The display device may further include first to N-th bias bus lines each extending in the column direction between two portions of each of the first to N-th second bias voltage lines opposing to each other, each of the first to N-th bias bus lines being arranged by every M pixel rows wherein M is an integer equal to or greater than 1.

The display device may further include first to N-th bias bus lines each extending in the column direction between two portions of each of the first to N-th second bias voltage lines opposing to each other, each of the first to N-th bias bus lines being arranged by every non-constant number of pixel rows.

It is preferable that each of the first to N-th second bias voltage lines is configured to be a closed loop.

It is preferable that each of the first to N-th third bias voltage lines has a width greater than a width of the associated second bias voltage line.

The advantages obtained by the aforementioned present invention will be described hereinbelow.

The display device in accordance with the present invention makes it possible to reduce and uniformize a wire resistance of a bias voltage line extending from a bias voltage generating circuit to each of pixels, even if a bias voltage line would have an increased wire length because of an increase in the number of pixels, avoid reduction in a brightness caused by reduction in a current running through a light-emitting device, resulted from an increase in a wire resistance in a bias voltage line, and avoids non-uniformity in a brightness in a display screen, caused by non-uniformity in a wire resistance in bias voltage lines extending from a bias voltage generating circuit to each of pixels.

The display device in accordance with the present invention also makes it possible to reduce a wire resistance in bias voltage lines to thereby reduce power consumption in the bias voltage lines.

In addition, reduction in power consumption in bias voltage lines ensures an extension in lifetime of bias voltage lines.

Since the second bias voltage line has a large area surrounded by itself, it would be possible to uniformize a bias voltage to be applied through a bias voltage line, and improve an image quality in the display device, by forming a capacitor by means of the second bias voltage line to thereby remove spike noises entering the second bias voltage line.

In addition, it would be possible to optimally compensate for color balance by controlling a bias voltage to thereby control a current running through a light-emitting device, even if a light emission efficiency of the light-emitting device is lowered with an increase in a total period of time during which the light-emitting device emits a light, and resultingly, the light-emitting device is degraded.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 3:
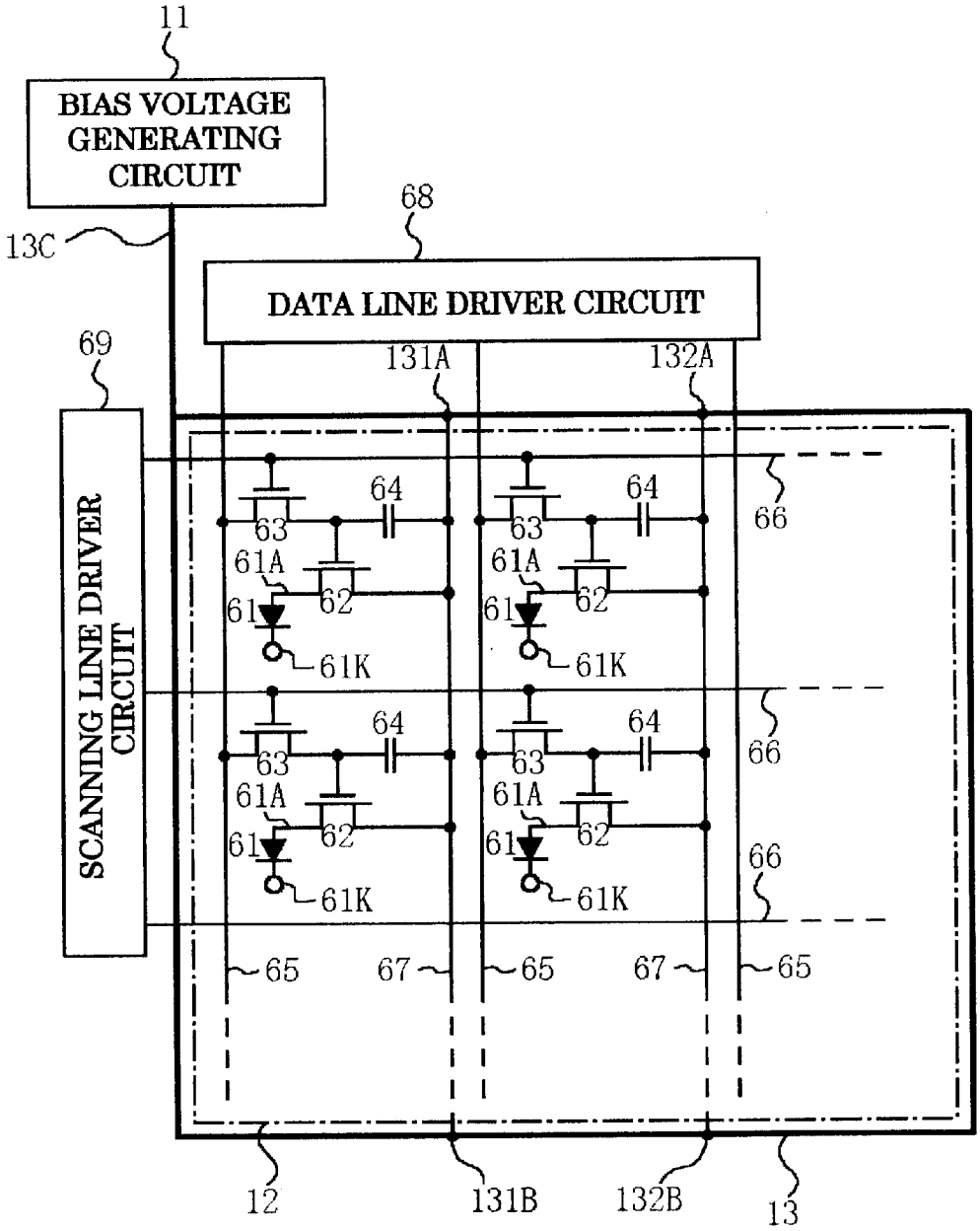
FIG. 3 is a block diagram of a display device in accordance with the first embodiment of the present invention.

FIG. 3 is a block diagram of a display device in accordance with the first embodiment of the present invention.

The display device in accordance with the first embodiment is comprised of a data line driver circuit 68 to which a plurality of data lines 65 are electrically connected and which drives the data lines 65, a scanning line driver circuit 69 to which a plurality of scanning lines 66 are electrically connected and which drives the scanning lines 66, a bias voltage generating circuit 11 which drives later mentioned first bias voltage lines 67, a plurality of first bias voltage lines 67, a second bias voltage line 13, a third bias voltage line 13C electrically connecting the bias voltage generating circuit 11 to the second bias voltage line 13, and a plurality of pixels arranged in a matrix.

Each of the pixels is comprised of an electroluminescence device 61 having an anode 61A and a cathode 61C to which a constant bias voltage is applied, a first thin film transistor (TFT) 62 electrically connected between the anode 61A of the electroluminescence device 61 and one of the first bias voltage lines 67, a second thin film transistor (TFT) 63 electrically connected between one of the data lines 65 and a gate of the first thin film transistor 62, and a capacitor 64 electrically connected between a gate of the first thin film transistor 62 and one of the first bias voltage lines 67.

The second bias voltage line 13 is rectangular in shape, and surrounds a pixel area 12 in which the pixels are arranged in a matrix.

The second bias voltage line 13 is electrically connected to an output terminal of the bias voltage generating circuit 11 through the third bias voltage line 13C. Each of the first bias voltage lines 67 is connected to the second bias voltage line 13 at nodes 131A and 131B, 132A and 132B, - - - , respectively.

Figure 1:
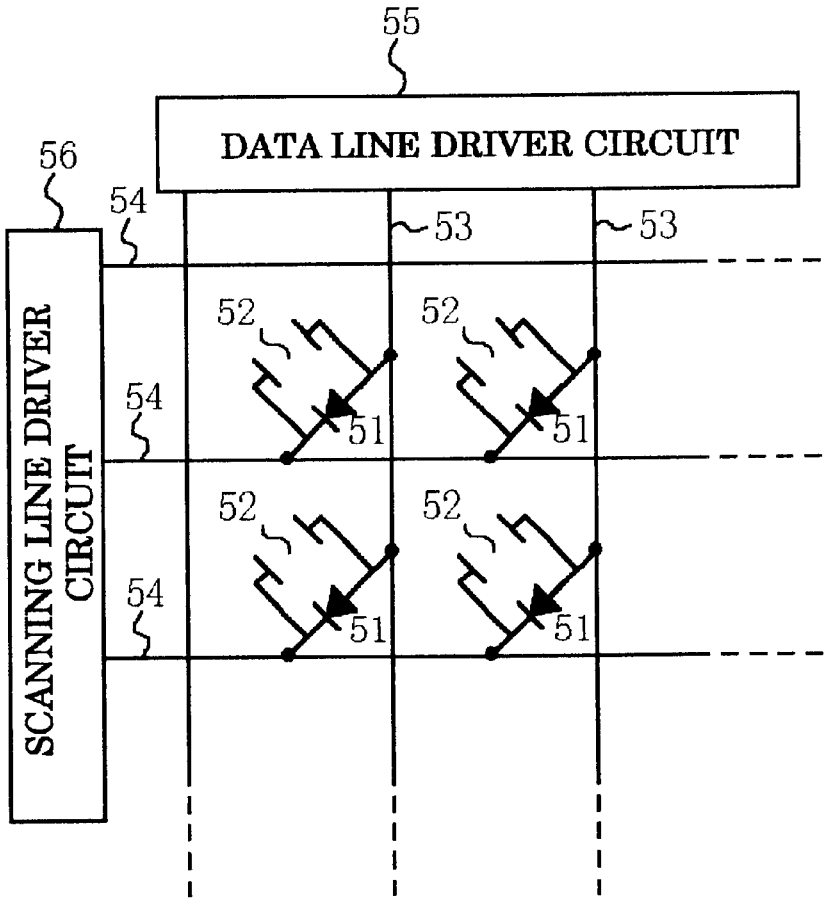
FIG. 1 PRIOR ART
FIG. 1 is a block diagram of a conventional simple matrix type organic electroluminescence display device.
Figure 2:
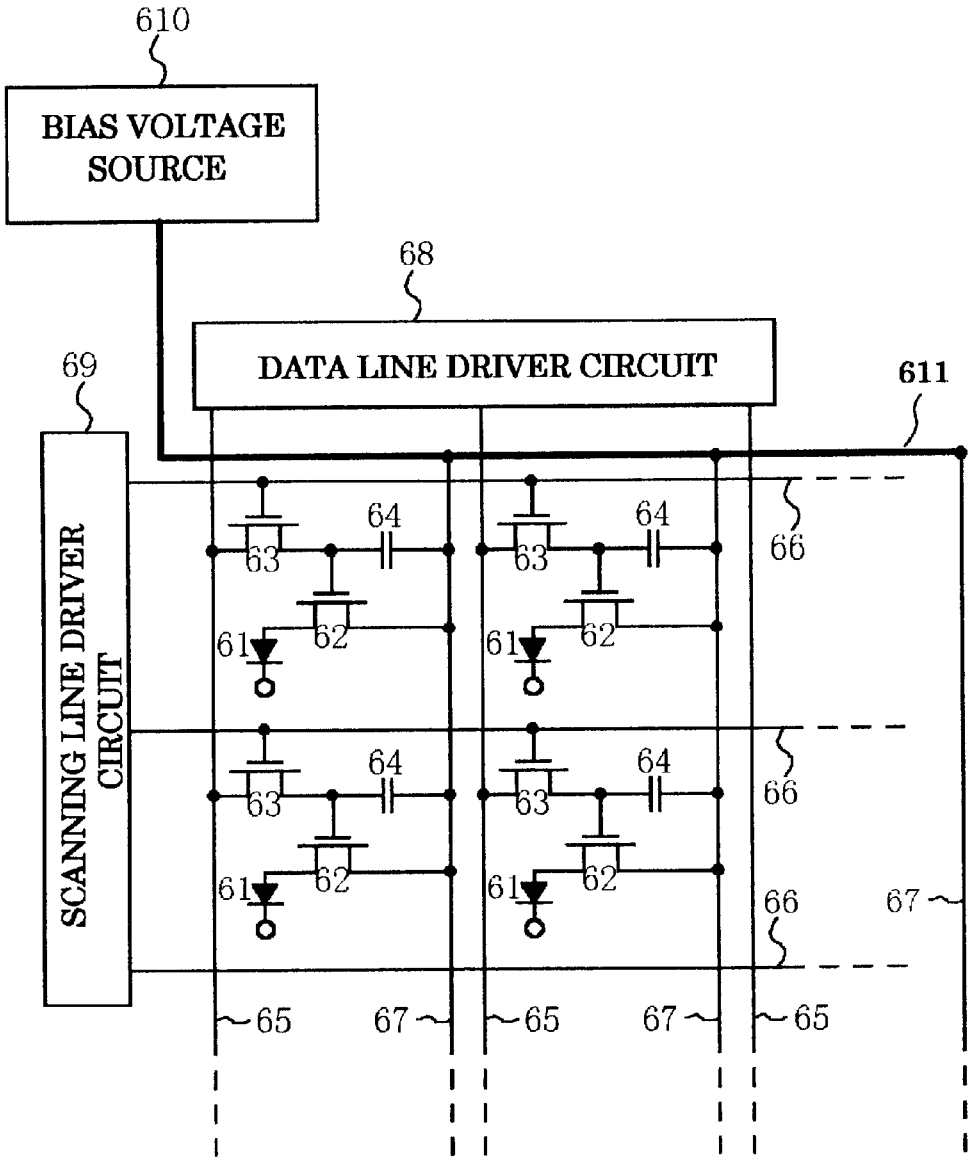
FIG. 2 PRIOR ART
FIG. 2 is a block diagram of a conventional active matrix type organic electroluminescence display device.

In the conventional active matrix type organic electroluminescence display device illustrated in FIG. 2, each of the bias voltage lines 67 is connected to the common bias voltage line 611 at one node, and the common bias voltage line 611 is electrically connected to an output terminal of the bias voltage source 610. In contrast, in the display device in accordance with the first embodiment, illustrated in FIG. 3, each of the first bias voltage lines 67 is connected to the second bias voltage line 13 at both upper nodes 131A, 132A, - - - , and lower nodes 131B, 132B, - - - .

When the scanning line driver circuit 69 activates one of the scanning lines 66, the second thin film transistor 63 electrically connected to the thus activated scanning line 66 is turned on, and hence, a current runs into the capacitor 64 through the data line 65 and the second thin film transistor 63 from the data line driver circuit 68, resulting in that the capacitor 64 is electrically charged.

When the scanning line driver circuit 69 inactivates one of the scanning lines 66, the second thin film transistor 63 electrically connected to the thus inactivated scanning line 66 is turned off, and hence, electric charges accumulated in the capacitor 64 are kept accumulated as they are, and the capacitor 64 electrically connected to a gate of the first thin film transistor 62 has a constant terminal voltage. The terminal voltage is biased to a gate of the first thin film transistor 62. When a gate voltage in the first thin film transistor 62 becomes higher than a threshold voltage, the first thin film transistor 62 is turned on. As a result, a current is supplied to the electroluminescence device 61 from the bias voltage generating circuit 11 through the third bias voltage line 13C, the second bias voltage line 13, and the first bias voltage line 67, and the electroluminescence device 61 emits a light with a brightness defined in accordance with the supplied current.

A current Iel to be supplied to the electroluminescence device 61 is defined by a gate voltage and a voltage between a source and a drain in the first thin film transistor 62. When a width of a pulse to be applied to a gate is varied to thereby accomplish multi gradation, for instance, in accordance with the processes suggested in Japanese Patent No. 2784615 or Japanese Unexamined Patent Publication No. 11-231835, a voltage between a source and a drain in the first thin film transistor 62 is in the range of 0.1 to 0.2 voltage at greatest. A voltage at the anode 61A of the electroluminescence device 61 is calculated by subtracting a voltage between a source and a drain in the first thin film transistor 62 from an output voltage Vb output from the bias voltage generating circuit 11. Accordingly, when gradation is controlled by varying a width of a pulse to be applied to a gate, the current Iel is dependent on the output voltage Vb output from the bias voltage generating circuit 11.

In other words, in the display device in accordance with the first embodiment, gradation associated with an image signal to be input through the data line 65 is controlled by a width of a pulse to be applied to a gate of the first thin film transistor 62, and a brightness based on which gradation is determined is controlled by the voltage Vb output from the bias voltage generating circuit 11.

In FIG. 3, the second bias voltage line 13 is composed of a material having a low resistivity in order to reduce a wire resistance, and is designed to have a wire width greater than width of the scanning line 66 and the first bias line 67 both located in the pixel area 12.

Accordingly, a wire resistance from each of the pixels to the output terminal of the bias voltage generating circuit 11 through the first, second and third bias voltage lines 67, 13 and 13C is remarkably smaller than a wire resistance from each of the pixels to the bias voltage source 610 in the conventional active matrix type organic EL display device illustrated in FIG. 2, because the second bias voltage line 13 has a small wire resistance, and further because each of the first bias voltage lines 67 is connected to the second bias voltage line 13 at the upper and lower nodes 131A, 132A, - - - and 131B, 132B, - - - .

An example of the above-mentioned case is explained hereinbelow.

The bias voltage generating circuit 11 output a current to the first bias voltage line 67 through the third bias voltage line 13C having a low resistance, the second bias voltage line 13, and the nodes 131A and 131B. The current is supplied to the light-emitting device 61 constituting the pixel which is electrically connected to the first bias voltage line 67 and activated.

Accordingly, a voltage gradient in the first bias voltage line 67 is significantly relaxed, and non-uniformity in a brightness caused by non-uniformity in a current running through the light-emitting device 61 can be remarkably improved.

In other words, if a voltage output from the bias voltage generating circuit 11, and a brightness in a pixel located in the pixel area 12, namely, a current associated with a brightness of the light-emitting device constituting the pixel are given, wire resistances of the second bias voltage line 13 and the third bias voltage line 13C are calculated so as to satisfy the thus given voltage and brightness (or current), and the second bias voltage line 13 and the third bias voltage line 13C are designed to have the thus calculated wire resistance.

The second bias line 13 may be formed so as to have a low resistance by layering the second bias voltage line 13 and the first bias voltage lines 67 or the scanning lines 66 one on another, and electrically connecting them through via-holes.

The second bias voltage line 13 and the scanning lines 66 are formed so as not to short-circuit with each other when the second bias voltage line 13 and the scanning lines 66 overlap each other, except the scanning lines extending in parallel with a vertically extending portion of the second bias voltage line 13.

The second bias voltage line 13 may be designed to have an inner area defined as an area surrounded by the second bias voltage line 13 which inner area is larger than a predetermined area. The second bias voltage line 13 having such an inner area can define a capacity which is capable of removing spike-like noises entering the second bias voltage line 13. This ensures that a bias voltage applied from the bias voltage generating circuit 11 is stabilized, and resultingly, image quality in a display screen can be enhanced.

As mentioned earlier, the conventional simple matrix type organic EL display device and the conventional active matrix type organic EL display device have a common problem that extra power has to be supplied to the bias voltage lines from the bias voltage source in order to compensate for reduction in a brightness in a pixel which reduction is caused by an increase in a wire resistance in the bias voltage lines. This problem is quite serious to a display device required to accomplish reduction in power consumption.

In accordance with the display device in the first embodiment, since the first, second and third bias voltage lines 67, 13 and 13C connecting the bias voltage generating circuit 11 to each of the pixels would have a reduced wire resistance, even if the first and second bias voltage lines had an increased wire length because of an increase in the number of pixels, power consumption in the pixels can be reduced, ensuring reduction in power consumption in the overall display device.

Figures 4A, 4B:
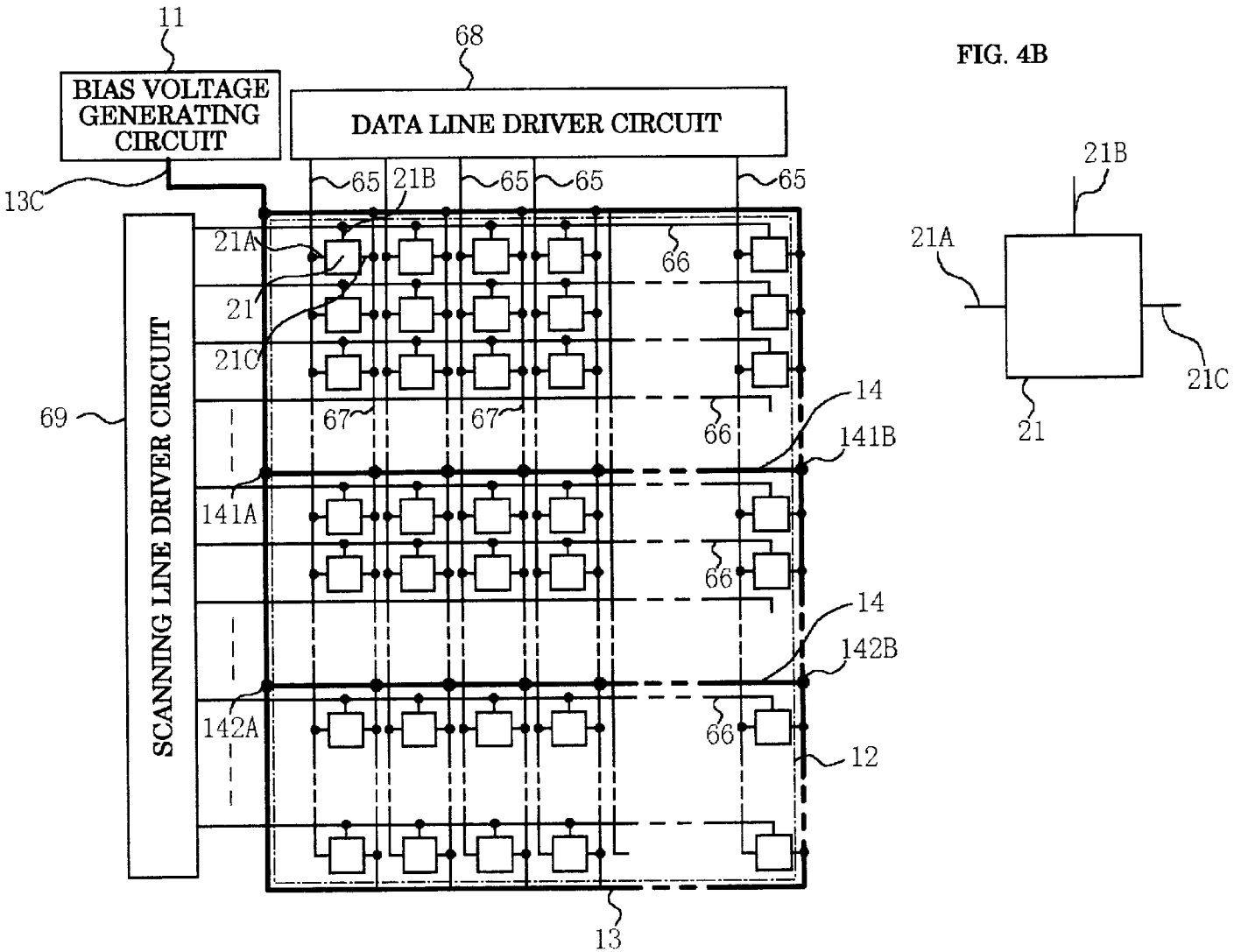
FIG. 4A is a block diagram of a display device in accordance with the second embodiment of the present invention.
FIG. 4B is an enlarged view of a pixel in the display device illustrated in FIG. 4A.

FIG. 4A is a block diagram of a display device in accordance with the second embodiment of the present invention, and FIG. 4B is an enlarged view of a pixel in the display device illustrated in FIG. 4A.

The display device in accordance with the second embodiment is comprised of a data line driver circuit 68 to which a plurality of data lines 65 are electrically connected and which drives the data lines 65, a scanning line driver circuit 69 to which a plurality of scanning lines 66 are electrically connected and which drives the scanning lines 66, a bias voltage generating circuit 11 which drives later mentioned first bias voltage lines 67, a plurality of first bias voltage lines 67, a second bias voltage line 13, a third bias voltage line 13C electrically connecting the bias voltage generating circuit 11 to the second bias voltage line 13, a plurality of bias bus lines 14, and a plurality of pixels 21 arranged in a matrix in a pixel area 12.

Each of the pixels has the same structure as the structure of the pixel in the first embodiment.

As illustrated in FIG. 4B, each of the pixel 21 is designed to have a first connection port 21A at which the scanning line 66 is connected to the pixel, a second connection port 21B at which the data line 65 is connected to the pixel, and a third connection port 21C at which the first bias voltage line 67 is connected to the pixel.

The second bias voltage line 13 is rectangular in shape, and surrounds the pixel area 12 in which the pixels 21 are arranged in a matrix.

The second bias voltage line 13 is electrically connected to an output terminal of the bias voltage generating circuit 11 through the third bias voltage line 13C. Each of the first bias voltage lines 67 is connected to the second bias voltage line 13 at upper and lower nodes 131A, 132A, - - - and 131B, 132B, - - - .

The bias bus lines 14 have a small wire resistance, and extend in parallel with the scanning lines 66 between vertically extending portions of the second bias voltage line 13. The bias bus lines 14 are electrically connected to the second bias voltage line 13 at nodes 141A and 141B, 142A and 142B, - - - .

The first bias voltage lines 67 and the bias bus lines 14 are electrically connected to each other at intersections of them. That is, by arranging the bias bus lines 14 by every M rows of the pixels 21 wherein M is an integer equal to or greater than 1, it would be possible to shorten a wire length of the first bias voltage lines 67 having a high resistivity which wire length contributes to a wire resistance of the first bias voltage lines 67. As a result, it would be possible to significantly reduce a wire resistance in a path from each of the pixels 21 to the bias voltage generating circuit 11 through the bias bus lines 14, the second bias voltage line 13 and the third bias voltage line 13C.

Though the bias bus lines 14 are arranged by every M rows of the pixels in the second embodiment, the bias bus lines 14 may be arranged by every non-constant number of pixel rows. For instance, a first bias bus line may be arranged between second and third rows of the pixels 21, a second bias bus line may be arranged between fifth and sixth rows of the pixels 21, and a third bias bus line may be arranged between tenth and eleventh rows of the pixels 21. That is, the first bias bus line is spaced away from the second bias voltage line 13 by two rows of the pixels, the second bias bus line is spaced away from the first bias bus line by three rows of the pixels, and the third bias bus line is spaced away from the second bias bus line by five rows of the pixels.

By arranging a plurality of bias bus lines by every non-constant number of pixel rows, it would be possible to substantially equalize wire resistances in wires from each of the pixels 21 to the bias voltage generating circuit 11, taking into consideration that a current density is different from one another in each of the wires.

Figure 5:
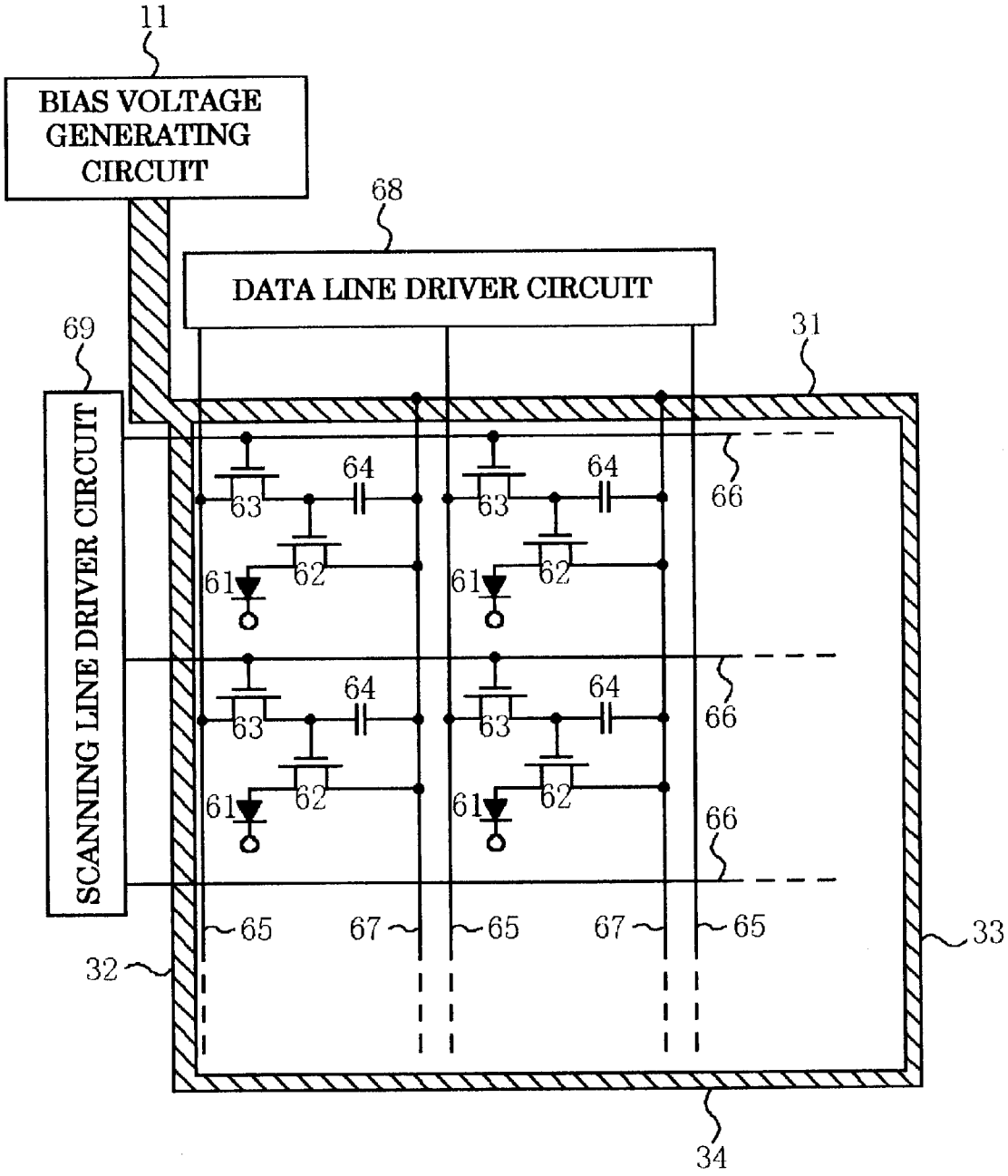
FIG. 5 is a block diagram of a display device in accordance with the third embodiment of the present invention.

FIG. 5 is a block diagram of a display device in accordance with the third embodiment of the present invention.

The display device in accordance with the third embodiment has the same structure as the structure of the display device in accordance with the first embodiment, illustrated in FIG. 3, except a structure of the second bias voltage line 13.

In the display device in accordance with the third embodiment, the second bias voltage line 13 is designed to have a greater width at a location closer to the bias voltage generating circuit 11, and have a smaller width at a location farther away from the bias voltage generating circuit 11.

Specifically, the second bias voltage line 13 is comprised of a first bias voltage line segment 31 connected to the third bias voltage line 13C and horizontally extending, a second bias voltage line segment 32 connected to the third bias voltage line 13C and vertically extending, a third bias voltage line segment 33 connected to the first bias voltage line segment 31 and vertically extending, and a fourth bias voltage line segment 34 connected to the second bias voltage line segment 32 and horizontally extending.

The first bias voltage line segment 31 has a width equal to that of the second bias voltage line segment 32. The third bias voltage line segment 33 has a width equal to that of the fourth bias voltage line segment 34.

The third bias voltage line 13C is designed to have a greater width than a width of the first and second bias voltage line segments 31 and 32, and the first and second bias voltage line segments 31 and 32 are designed to have a greater width than a width of the third and fourth bias voltage line segments 33 and 34.

Though the third bias voltage line 13C and the first to fourth bias voltage lines 31 to 34 are designed to have a fixed width in the third embodiment, they may be designed to be tapered. Specifically, the third bias voltage line 13C may be tapered such that a portion closer to the bias voltage generating circuit 11 has a greater width and a portion farther away from the bias voltage generating circuit 11 has a smaller width. Similarly, the first and fourth bias voltage line segments 31 and 34 may be tapered such that a portion closer to the left end has a greater width and a portion closer to the right end has a smaller width. Similarly, the second and third bias voltage line segments 32 and 33 may be tapered such that a portion closer to the upper end has a greater width and a portion closer to the lower end has a smaller width.

By designing the third and second bias voltage lines 13C and 13 such that a portion located closer to the bias voltage generating circuit 11 has a greater width and a portion located farther away from the bias voltage generating circuit 11, it would be possible to substantially equalize wire resistances in wires from each of the pixels 21 to the bias voltage generating circuit 11, taking into consideration that a current density is different from one another in each of the wires.

Figure 6:
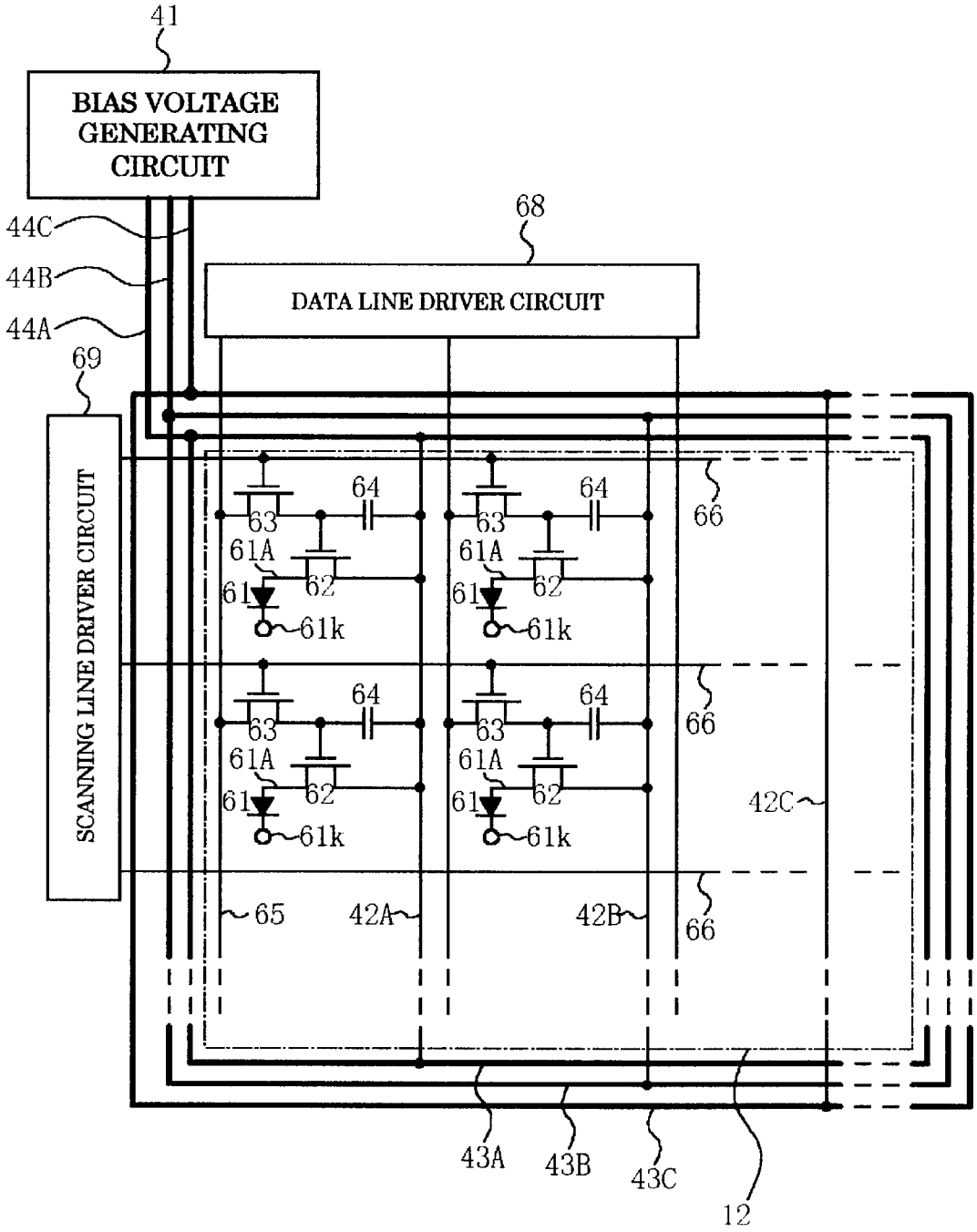
FIG. 6 is a block diagram of a display device in accordance with the fourth embodiment of the present invention.

FIG. 6 is a block diagram of a display device in accordance with the fourth embodiment of the present invention.

The display device in accordance with the fourth embodiment is structurally different from the display device in accordance with the first embodiment, illustrated in FIG. 3, with respect to the number of the second bias voltage lines 13. Specifically, whereas the display device in accordance with the first embodiment is designed to include one second bias voltage line 13, the display device in accordance with the fourth embodiment is designed to include three second bias voltage lines 43A, 43B and 43C and three associated third bias voltage lines 44A, 44B and 44C.

The second bias voltage line 43A surrounds the pixel area 12, and is electrically connected to a first output port (not illustrated) of a bias voltage generating circuit 41 through the third bias voltage line 44A. A plurality of first bias voltage lines 42A are electrically connected to the second bias voltage line 43A at upper and lower nodes.

The second bias voltage line 43B surrounds the second bias voltage line 43A, and is electrically connected to a second output port (not illustrated) of the bias voltage generating circuit 41 through the third bias voltage line 44B. A plurality of first bias voltage lines 42B are electrically connected to the second bias voltage line 43B at upper and lower nodes.

The second bias voltage line 43C surrounds the second bias voltage line 43B, and is electrically connected to a third output port (not illustrated) of the bias voltage generating circuit 41 through the third bias voltage line 44C. A plurality of first bias voltage lines 42C are electrically connected to the second bias voltage line 43C at upper and lower nodes.

The second bias voltage lines 43A, 43B and 43C are electrically independent of one another.

Though not illustrated in FIG. 6, the first bias voltage lines in fourth to sixth columns are electrically connected to the second bias voltage lines 43A to 43C at upper and lower nodes, respectively. The first bias voltage lines in seventh or greater columns are electrically connected to the second bias voltage lines 43A to 43C at upper and lower nodes in the same way.

The structure of the display device in accordance with the fourth embodiment makes it possible to control a current running through the electroluminescence devices 61 independently column by column, and hence, it would be possible to control a brightness of the electroluminescence devices 61 in each of rows.

Hereinbelow is explained an example.

For instance, first electroluminescence devices each emitting a red light are arranged in the leftmost column, second electroluminescence devices each emitting a green light are arranged in a column adjacent to the leftmost column, and third electroluminescence devices each emitting a blue light are arranged in a column adjacent to the previous column. The first, second and third electroluminescence devices are repeatedly arranged in this order in the example display device.

In accordance with the example display device, even if light emission efficiencies of the first to third electroluminescence devices are deteriorated as a total period of time during which the first to third electroluminescence devices emit red, green and blue lights increases, and hence, the first to third electroluminescence devices are degraded, it would be possible to control a brightness of each of the first to third electroluminescence devices, and hence, color balance could be compensated for to be kept optimal.

The display device in accordance with the fourth embodiment makes it possible to control a current running through the electroluminescence devices 61 independently column by column, and hence, it would be possible to control a brightness of the electroluminescence devices 61 in each of rows. In addition, a plurality of the second bias voltage lines 43A to 43C significantly relaxes a voltage gradient in the first bias voltage lines 42A to 42C, and resultingly, it would be possible to improve non-uniformity in a brightness, caused by the voltage gradient, and the non-uniformity in a current running through the electroluminescence devices, associated with the voltage gradient.

In accordance with the display device in the fourth embodiment, since the first, second and third bias voltage lines connecting the bias voltage generating circuit 41 to each of the pixels would have a reduced wire resistance, even if the first and second bias voltage lines had an increased wire length because of an increase in the number of pixels, power consumption in the pixels can be reduced, ensuring reduction in power consumption in the overall display device.

Though the display device in accordance with the fourth embodiment is designed to include the three second bias voltage lines 43A to 43C and the associated three third bias voltage lines 44A to 44C, the number of the second and third bias voltage lines is not to be limited to three. The display device may be designed to include two, four or more second and third bias voltage lines.

Though not illustrated, the display device in accordance with the fourth embodiment may be designed to include the bias bus lines 14 illustrated in FIG. 4A, in which case, the bias bus lines 14 are formed in association with each of the second bias voltage lines.

By designing the display device to include the bias bus lines 14, it would be possible to shorten a wire length of the first bias voltage lines 42A to 42C having a high resistivity which wire length contributes to a wire resistance of the first bias voltage lines 42A to 42C. As a result, it would be possible to significantly reduce a wire resistance in a path from each of the pixels to the bias voltage generating circuit 41 through the bias bus lines 14, the second bias voltage lines 43A to 43C, and the third bias voltage lines 44A to 44C.

In the above-mentioned first to fourth embodiments, the electroluminescence device 61 is used as a light-emitting device. However, it should be noted that a light-emitting device other than an electroluminescence device may be applied to the display device in accordance with the present invention.

In the display device illustrated in FIG. 6, sources or drains of the first thin film transistors 62 arranged in the same column are electrically connected to the first bias voltage line 42A, 42B or 42C. However, it should be noted that sources or drains of the first thin film transistors 62 arranged in the same row may be electrically connected to the first bias voltage line 42A, 42B or 42C.

In the above-mentioned first to fourth embodiments, the second bias voltage lines 13, 31 to 34 and 43A to 43C are configured to be a closed loop. However, it should be noted that it is not always necessary for the second bias voltage lines to a closed loop. The second bias voltage lines are merely required to surround the pixel area 12 in a loop.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2000-228405 filed on Jul. 28, 2000 including specification, claims, drawings and summary is incorporated herein by reference in its entirety.

What is claimed is:

1. A display device comprising:

(a) a plurality of pixels arranged in a matrix, each of said pixels including a light-emitting device, a switch and a transistor;

(b) at least one scanning line extending in a first direction;

(c) at least one data line extending in a second direction perpendicular to said first direction;

(d) at least one first bias voltage line extending in said second direction;

(e) a bias voltage generating circuit which applies a bias voltage to said bias voltage line;

(f) a second bias voltage line which surrounds said pixels; and (g) a third bias voltage line which electrically connects said bias voltage generating circuit to said second bias voltage line, said light-emitting device being electrically connected to one of a source and a drain of said transistor, said first bias voltage line being electrically connected to the other of a source and a drain of said transistor, said transistor having a gate electrically connected to said data line through said switch, said first bias voltage line being electrically connected at opposite ends thereof to said second bias voltage line, said switch being turned on when said scanning line is activated, to thereby allow image signals to be transmitted to said gate of said transistor therethrough from said data line, said second and third bias voltage lines being designed to have such a wire resistance that a constant current is supplied to said light-emitting device from said bias voltage generating circuit through said first, second and third bias voltage lines.

2. The display device as set forth in claim 1, wherein said second bias voltage line is rectangular in shape.

3. The display device as set forth in claim 1, further comprising a first driver which drives said scanning line a second driver which drives said data line.

4. The display device as set forth in claim 1, further comprising a capacitor electrically connected between said gate and said source or drain of said transistor.

5. The display device as set forth in claim 1, wherein said light-emitting device is comprised of an electroluminescence (EL) device.

6. The display device as set forth in claim 1, wherein said second bias voltage line is comprised of a plurality of bias voltage line segments, and wherein a bias voltage line segment located closer to said bias voltage generating circuit is designed to have a smaller wire resistance per a unit length.

7. The display device as set forth in claim 1, wherein said second bias voltage line is comprised of a plurality of bias voltage line segments, and wherein a bias voltage line segment located closer to said bias voltage generating circuit is designed to have a broader width.

8. The display device as set forth in claim 7, wherein said bias voltage line segment is tapered in width.

9. The display device as set forth in claim 1, wherein said second bias voltage line is comprised of a first wiring layer having a resistivity smaller than a predetermined resistivity, and a wiring layer of said scanning or data line, said first wiring layer and said wiring layer being vertically layered one on another, said first wiring layer and said wiring layer being connected to each other through a through-hole.

10. The display device as set forth in claim 1, wherein said second bias voltage line has an inner area defined as an area surrounded by itself, said inner area being greater than a predetermined area such that said second bias voltage line acts as a capacitor for removal of noises.

11. The display device as set forth in claim 1, further comprising at least one bias bus line extending in said first direction between two portions of said second bias voltage line opposing to each other.

12. The display device as set forth in claim 1, further comprising bias bus lines extending in said first direction between two portions of said second bias voltage line opposing to each other, said bias bus lines being arranged by every M pixel rows wherein M is an integer equal to or greater than 1.

13. The display device as set forth in claim 1, further comprising bias bus lines extending in said first direction between two portions of said second bias voltage line opposing to each other, said bias bus lines being arranged by every non-constant number of pixel rows.

14. The display device as set forth in claim 1, wherein said second bias voltage line is configured to be a closed loop.

15. The display device as set forth in claim 1, wherein said third bias voltage line has a width greater than a width of said second bias voltage line.

16. A display device comprising:

(a) a plurality of pixels arranged in a matrix, each of said pixels including a light-emitting device, a switch and a transistor;

(b) at least one scanning line extending in a column direction;

(c) at least one data line extending in a row direction;

(d) first to N-th first bias voltage lines extending in said column direction wherein N is an integer equal to or greater than 2;

(e) a bias voltage generating circuit having first to N-th output terminals through which a bias voltage is applied to said first to N-th first bias voltage lines;

(f) first to N-th second bias voltage lines which surround said pixels; and (g) first to N-th third bias voltage lines which electrically connects said first to N-th output terminals of said bias voltage generating circuit to said first to N-th second bias voltage lines, respectively, said light-emitting device being electrically connected to one of a source and a drain of said transistor, said first to N-th first bias voltage lines being electrically connected to the other of a source and a drain of said transistor in said first to N-th rows, said transistor having a gate electrically connected to said data line through said switch, each of said first to N-th first bias voltage lines being electrically connected at opposite ends thereof to an associated second bias voltage line among said first to N-th second bias voltage lines, said switch being turned on when said scanning line is activated, to thereby allow image signals to be transmitted to said gate of said transistor therethrough from said data line, said first to N-th second and third bias voltage lines being designed to have such a wire resistance that a constant current is supplied to said light-emitting device from said bias voltage generating circuit through said first to N-th first, second and third bias voltage lines.

17. The display device as set forth in claim 16, wherein each of said first to N-th second bias voltage lines is rectangular in shape.

18. The display device as set forth in claim 16, further comprising a first driver which drives said scanning line a second driver which drives said data line.

19. The display device as set forth in claim 16, further comprising a capacitor electrically connected between said gate and said source or drain of said transistor.

20. The display device as set forth in claim 16, wherein said light-emitting device is comprised of an electroluminescence (EL) device.

21. The display device as set forth in claim 16, wherein each of said first to N-th second bias voltage line is comprised of a plurality of bias voltage line segments, and wherein a bias voltage line segment located closer to said bias voltage generating circuit is designed to have a smaller wire resistance per a unit length.

22. The display device as set forth in claim 16, wherein each of said first to N-th second bias voltage lines is comprised of a plurality of bias voltage line segments, and wherein a bias voltage line segment located closer to said bias voltage generating circuit is designed to have a broader width.

23. The display device as set forth in claim 22, wherein said bias voltage line segment is tapered in width.

24. The display device as set forth in claim 16, wherein each of said first to N-th second bias voltage lines is comprised of a first wiring layer having a resistivity smaller than a predetermined resistivity, and a wiring layer of said scanning or data line, said first wiring layer and said wiring layer being vertically layered one on another, said first wiring layer and said wiring layer being connected to each other through a through-hole.

25. The display device as set forth in claim 16, wherein an innermost second bias voltage line among said first to N-th second bias voltage lines has an inner area defined as an area surrounded by itself, said inner area being greater than a predetermined area such that said innermost second bias voltage line acts as a capacitor for removal of noises.

26. The display device as set forth in claim 16, further comprising first to N-th bias bus lines each extending in said column direction between two portions of each of said first to N-th second bias voltage lines opposing to each other.

27. The display device as set forth in claim 16, further comprising first to N-th bias bus lines each extending in said column direction between two portions of each of said first to N-th second bias voltage lines opposing to each other, each of said first to N-th bias bus lines being arranged by every M pixel rows wherein M is an integer equal to or greater than 1.

28. The display device as set forth in claim 16, further comprising first to N-th bias bus lines each extending in said column direction between two portions of each of said first to N-th second bias voltage lines opposing to each other, each of said first to N-th bias bus lines being arranged by every non-constant number of pixel rows.

29. The display device as set forth in claim 16, wherein each of said first to N-th second bias voltage lines is configured to be a closed loop.

30. The display device as set forth in claim 16, wherein each of said first to N-th third bias voltage lines has a width greater than a width of the associated second bias voltage line.

* * * * *